US005843328A

United States Patent [19]

Pacifici et al.

[11] Patent Number: 5,843,328

[45] Date of Patent: Dec. 1, 1998

[54] NYLON FIBER PROTECTIVE FINISHING COMPOSITIONS AND METHODS OF MANUFACTURING SAME

[75] Inventors: Joseph A. Pacifici, Anderson; Daniel G. Sims, Greer, both of S.C.

[73] Assignee: Simco Holding Corp., Greer, S.C.

[21] Appl. No.: 900,850

[22] Filed: Jul. 25, 1997

[51] Int. Cl.[6] ..... D06M 15/256

[52] U.S. Cl. ..... 252/8.62; 252/8.61; 252/8.81; 428/96; 428/395

[58] Field of Search ..... 252/8.61, 8.62, 252/8.81; 428/96, 395

[56] References Cited

U.S. PATENT DOCUMENTS

| | | | |
|---|---|---|---|
| 4,680,212 | 7/1987 | Blyth et al. | 428/97 |
| 4,839,212 | 6/1989 | Blyth et al. | 428/96 |
| 4,857,392 | 8/1989 | Kirjanov et al. | 428/267 |
| 4,875,901 | 10/1989 | Payet et al. | 8/115.56 |
| 4,879,180 | 11/1989 | Blyth et al. | 428/395 |
| 4,937,123 | 6/1990 | Chang et al. | 428/966 |
| 5,009,667 | 4/1991 | Beck et al. | 8/115.56 |
| 5,059,420 | 10/1991 | Scholla et al. | 424/339.4 |
| 5,084,191 | 1/1992 | Nagase et al. | 252/8.62 |
| 5,084,306 | 1/1992 | McLellan et al. | 427/339.4 |
| 5,153,046 | 10/1992 | Murphy | 252/8.62 |
| 5,308,511 | 5/1994 | Coppens et al. | 252/8.62 |
| 5,464,584 | 11/1995 | Yeh | 264/103 |
| 5,509,939 | 4/1996 | Kirchner | 252/8.62 |
| 5,714,082 | 2/1998 | Boardman et al. | 252/8.62 |

FOREIGN PATENT DOCUMENTS 268 374 5/1988 European Pat. Off. .

OTHER PUBLICATIONS

WPIDS Abstract No. 90–031618 which ia an abstract of European Patent Specification No. 353080, Jan. 1990.

J.R.Aspland,Continuous Nylon Carpet Dyeing vol. 25, No. 5, pp. 35–39 May 1993, Textile Chemist and Colorist.

Chemical Analysis of Yellowing of Stain Resist Finishes for Carpets vol. 21, No. 4, pp. 21–23 Apr. 1989, Textile Chemist and Colorist.

Harris, et al, Stain Resist Chemistry for Nylon 6 Carpet vol. 21, No. 11, pp. 26–30 Nov. 1989, Textile Chemist and Colorist.

Reagan et al, Influence of Aftermarket Carpet Protectors on the Soiling, Flammability & Electrical Resistivity of Nylon 6 vol. 22, No. 4, pp. 16–20 Apr. 1990, Textile Chemist and Colorist.

Fort Worth/Harahan Surfactants Witco Corporation, Sales brochure Houston, Texas 77045 date unknown.

Basics of Dyeing and Finishing AATCC Workshop sponsored by AATCC Research Traingle Park, NC Feb. 2–3, 1989.

*Primary Examiner*—Anthony Green
*Attorney, Agent, or Firm*—Kennedy, Davis & Kennedy, PC

[57] ABSTRACT

Protective finishing compositions and methods of manufacturing such compositions for finishing carpet products with a stainblocker and fluorocarbon-based repellant in a one-step process, include first adding a naphthalene sulfonated salt to either a stainblocker or a fluorocarbon-based repellant and then adding the combination to the chemical not originally mixed with the naphthalene sulfonated salt.

10 Claims, No Drawings

NYLON FIBER PROTECTIVE FINISHING COMPOSITIONS AND METHODS OF MANUFACTURING SAME

TECHNICAL FIELD

The present invention relates to compositions for use in finishing and protecting nylon fibers and to methods of manufacturing such compositions.

BACKGROUND OF THE INVENTION

Carpets today are commonly formed of polyamide fibers such as nylon that are woven into yarns and tufted. The tufted material is then colored with dyes and finished with softeners, fixing agents, stainblockers and fluorocarbon soil repellents. Until the middle 1980s, the primary carpet finishing process was the application of fluorocarbon polymer emulsions which imparted water and oil repellency. These fluorocarbon products were sprayed or foamed into the carpet fibers. At that time, however, nylon carpets were still susceptible to staining by natural and artificial acidic colorants commonly found in many foods and drinks such as in red wine and Kool Aid.

Due to the need to provide acid colorant stain protection in nylon carpet, a finishing technique was introduced to the carpet industry by DuPont under the name Stain Master in the middle 1980s. The Stain Master technique involves the application of a complex mixture known either as syntans, sulfonated novolacs, or sulfonated aromatic aldehyde condensation products (SAC) to carpet products. These colorless, polymeric, aromatic sulfonates are commonly referred to as "stainblockers" in the carpet industry. Stainblockers are generally water soluble anionic polymers with some being formulated with methacrylate polymers. Such polymeric salts are regularly described in articles of the American Association of Textile Chemists and Colorists (AATCC) magazine, the *Textile Chemist and Colorist*, an example of which is entitled Stain Resist Chemistry for Nylon 6 Carpet from the November 1989 issue, Volume 21, Number 11.

Currently, during manufacture, nylon carpets are conveyed onto continuous dye machines in which the stainblockers, for stain resistance, and fluorocarbons, for anti-soiling, are applied to the fabrics in two separate steps. Stainblockers and fluorocarbons have not been capable of being applied in a single step since fluorocarbon emulsion repellents coalesce in the presence of stainblockers.

In order to minimize the need for equipment, manpower, and overhead as a result of implementing two separate finishing processes, efforts have continued to consolidate the two finishing processes into one. To this end, U.S. Pat. No. 4,875,901 to Payet et. al. discloses a single step method in which nylon fibers are imparted with stain resistance and water and oil repellency by contacting the fibers with an aqueous solution of a stainblocker, a fluorocarbon, and a divalent metal salt. Although Payet et. al. does disclose a single step process, the process has not gained commercial acceptance, primarily due to the resultant carpet water and oil repellency being inconsistent and often below acceptable industry standards. This inconsistency results from the stainblocker's tendency to interfere with the fluorocarbon curing process, that process being a thermal reorientation of the fluorocarbon molecules.

When fluorocarbon emulsion products are mixed with stainblockers, the fluorocarbon emulsion destabilizes and a semi-solid mass forms. This is due to the fluorocarbon emulsion contacting the stainblocker. It is well known that emulsions are easily destabilized by the addition of salts. Essentially, the salts act as a coalescing agent causing an agglomeration of the emulsion. Since stainblockers are a form of salt, they destabilize the fluorocarbon emulsions as would a common salt. For instance, the addition of sodium chloride or sodium sulfate to a fluorocarbon emulsion results in the destabilization of the fluorocarbon emulsion and the formation of an unusable semi-solid mass.

Payet et. al. relies on the proposition that in a dilute aqueous solution the destabilizing effect should not occur, so that the stainblocker polymers and fluorocarbon polymer emulsions should give the same results in a one step application process as they do in a two step application process. Although this proposition applies to chemical combinations which fix or cure in aqueous solutions, such as stainblockers, it does not apply to chemical combinations which require heat for curing and which consequently cause the evaporation of water. For instance, in fluorocarbon polymer combinations which require heat for curing, the addition of salt adversely affects the fluorocarbon polymer performance. If a chemical combination includes one chemical requiring heat for curing, and that chemical combination is not compatible when mixed in concentrated form, poor performance will result even if the chemicals are compatible in dilute aqueous form. The rationale here is that as water evaporates from the dilute solution, the concentrations of the chemicals increase until they finally reach a level in which they are incompatible. In carpet products this occurs on the fibers and, though not visually observed, the adverse affect on the carpet can be measured by standard test methods. In a fluorocarbon/stainblocker polymer combination, it is always the performance of the fluorocarbon that is affected rather than that of the stainblocker. It is likely that these adverse effects result from the fluorocarbon having to be heat cured to give performance results, while stainblockers normally fix under aqueous conditions.

Improved stain resistance of carpets has remained an important but elusive industry objective as measurable by AATCC Test Method 175-1992. Water and oil repellency, however, has since the middle 1980s been dominated as a desired carpet property by the ability of carpet to resist soiling, as measured by AATCC test methods 122-1989 and 123-1989, and the ability of a carpet to be cleaned, as measured by AATCC test method 171-1989. Just as in water and oil repellency, soil resistance (anti-soiling) and cleaning are achieved by the use of anionic and non-ionic fluorocarbon emulsions. They are both liquids dispersed in immiscible liquids in colloidal size liquid droplets. Therefore, these carpet finishes continue to be applied in a two-step process with stainblockers in order to avoid the formation of the before mentioned mass. A viable one step application process using stainblockers added to dilute solutions of anti-soiling, cleaning, and oil and water repellant fluorocarbons which meets industry standards, has continued to elude the carpet manufacturing industry.

Thus it is seen that a need remains for protective finishing compositions that include both a stainblocker and a fluorocarbon-based repellant and yet which can be applied to a carpet in a single step without reduction of the effectiveness of the fluorocarbon-based repellant. Furthermore, a need remains for methods of manufacturing a protective finishing composition which includes both a fluorocarbon-based repellant and a stainblocker and yet which does not result in reduction of the effectiveness of the fluorocarbon-based repellant. Accordingly, it is to the provision of such methods and compositions that the present invention is primarily directed.

SUMMARY OF THE INVENTION

It has now been discovered that when a naphthalene sulfonated salt is added to a combination of a stainblocker and at least one type of fluorocarbon-based repellant, the naphthalene sulfonated salt functions as a fluorocarbon anti-coalescing agent. The resultant composition is unexpectedly stable for a lengthy period of time, forming a product that gives acceptable stain and soil resistance in nylon carpet fibers and yarns. The composition may be produced by mixing the naphthalene sulfonated salt with at least one fluorocarbon-based repellant and then mixing the resulting combination with a stainblocker. Alternatively, the naphthalene sulfonated salt can be mixed with the stainblocker and then the resulting combination mixed with the fluorocarbon-based repellant(s). Either way the result is a chemical composition that provides both fluorocarbon-based repellency (either water and oil repellency, soiling or cleaning repellency, or a combination thereof) and stainblocker protection, without agglomeration of the fluorocarbon-based repellant(s). The naphthalene sulfonated salt effectively slows down the agglomeration process to allow for the curing of both the stainblocker and the fluorocarbon-based repellant.

DETAILED DESCRIPTION OF THE INVENTION

Naphthalene sulfonated salts have been traditionally used as detergents or dispersants for carpet dyes and dye pigments. Generally, to synthesize naphthalene sulfonated salts, naphthalene or an alkylated derivative is sulfonated with sulfuric acid. The product backbone can then be extended by condensation with formaldehyde. Naphthalene sulfonated salt may be expressed by the following structural formula:

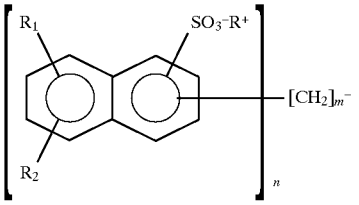

where R represents an alkali earth metal, preferably Li, Na, K, or Cs; with Na being the most preferred; $R_1$ represents hydrogen or an alkyl group having between 1 and 8 carbon atoms, with a methyl group being preferred; $R_2$ represents hydrogen or an alkyl group having between 1 and 20 carbon atoms, with alkyl groups having between 1 and 8 carbon atoms being preferred; n is between 1 and 30; m is equal to 0 or 1, but when m is 0, n is 1. The naphthalene sulfonated salt may either be a monomer or a polymer.

Naphthalene sulfonated salts and stainblockers are similar in that both may be sodium salts of sulfonated organic derivatives. For the purposes of this invention, the term "stainblocker" refers to syntans, sulfonated novolacs, and sulfonated aromatic aldehyde condensation products (SAC). Fluorocarbon-based repellents are generally anionic and, to a less extent, non-ionic polymer emulsions that impart repellency characteristics to carpet. The phrase "fluorocarbon repellant" describes water and oil repellents, soil repellents and cleaning repellents. Each of these fluorocarbon emulsion repellents rapidly agglomerate from the coalescing effects of stainblocker-type salts.

As previously stated, a proper mixture of a stainblocker and a fluorocarbon based repellant in the presence of a naphthalene sulfonated salt produces a product which has a substantial shelf life, without significant agglomeration. Several different fluorocarbon-based repellant and stainblocker mixtures are effective finishing compositions in the presence of naphthalene sulfonated salts. In this regard, non-ionic fluorocarbon emulsions (NFE), anionic fluorocarbon emulsions (AFE), naphthalene sulfonated sodium salts (NSS) and stainblockers (SB) were mixed in the following proportions and the resultant mixtures were observed for the formation of semi-solid masses.

TABLE 1

| | Mixtures | | | | | |
|---|---|---|---|---|---|---|
| | 1 % | 2 % | 3 % | 4 % | 5 % | 6 % |
| Water | 30 | 30 | 20 | 20 | 30 | 20 |
| NFE | 45 | — | 25 | 14 | — | 46 |
| AFE | — | 45 | 30 | 35 | 36 | — |
| NSS | — | — | — | 9 | 9 | 9 |
| SB | 25 | 25 | 25 | 22 | 25 | 25 |

While mixtures numbered 1, 2, and 3 were observed to be unstable, forming semi-solid masses, mixtures numbered 4, 5, and 6 were observed to be stable, forming uniform mixtures. The stable mixtures were tested for their effectiveness as finishing compositions on carpet samples. The carpets used in testing were fusion bonded tiles with a 28 oz/sq yd nylon 66 yarn, and a tenth gauge tufted 20 oz/sq yd nylon 6 yarn. The bonded yarn was pre-dyed while the tufted carpet was solution dyed. The mixtures were first each diluted in water to a level of 2.5% by weight. The mixtures were then placed in spray bottles and sprayed evenly over the carpet samples to a level of about 80 grams per 1.5 $ft^2$ carpet sample, and dried at 180° F. Several repeats were performed on mixtures 4 and 5 as well. Each carpet sample was tested for stain resistance using the AATCC Test Method 175-1992. Soil resistance was tested using AATCC Test Method 123-1989 and cleaning by AATCC Test Method 171-1989. The soiling and cleaning tests are graded on a scale of 1–5, with 1 being the least soil and clean resistant. Staining is graded on a scale of 1–10, with 1 being the least stain resistant. The results are shown in Table 2. The minimum acceptable standard for a two step application method is also presented for the purposes of comparison. For the purposes of these tests, bonded carpet was deemed too yellow to grade. A control carpet was untreated by fluorocarbon and stainblocker and was tested as is.

TABLE 2

| Carpet | Mixture | Staining | Soiling | Cleaning |
|---|---|---|---|---|
| Tufted | Control | 6 | 2 | 3.5 |
| Tufted | 6 | 10 | 2.5 | 3.5 |
| Tufted | 5 | 10 | 4 | 4.5 |
| Tufted | 5 | 10 | 4 | 4.5 |
| Tufted | 5 | 9.5 | 4 | 4.5 |
| Tufted | 4 | 9.0 | 3.5 | 4.0 |
| Tufted | 4 | 9.5 | 2.5 | 4.5 |
| Tufted | 4 | 9.5 | 2.5 | 4.5 |
| Bonded | 5 | 9.5 | 3.5 | N/A |
| Bonded | 5 | 9.5 | 3.5 | N/A |
| Two Step Method | | 8 | 2.5 | 3.5 |

These results show that a composition containing both a fluorocarbon emulsion and stainblocker gives acceptable stain resistance, soil resistance, and cleaning to nylon when that composition is stabilized with a naphthalene sulfonated sodium salt. Furthermore, the results show that the combined composition gives results in a one step process that are consistent with a two step process, as seen from the data on the last row of Table 2.

A preferable range of chemical mixture percentages which impart acceptable stain resistance, soil resistance, and cleaning on carpets, is expressed in the following table. These percentages may vary within their ranges according to the needs of the carpet manufacturer and the actual mix of components. For instance, while it is possible to include 1% of a fluorocarbon-based repellant in a mixture with no agglomeration readily occurring, such a small percentage of repellant would not be sufficient to provide adequate soil repellency protection to the carpet product. Conversely, a large percentage of fluorocarbon-based repellant may be included in a mixture, but not offer a proportionally greater amount of protection for the added costs of the repellant. These ranges are preferred not because of operability, but are practically dictated to meet the industry standards for soil repellency, and stainblocking finishes.

TABLE 3

| Chemical | APPROX % by weight of total composition |
|---|---|
| NFE | 14–50 |
| AFE | 25–50 |
| NSS | 8–12 |
| SB | 15–30 |

It should be realized that the sum of all of the fluorocarbon ingredients should be approximately in the range of 25–50w by weight.

In producing the finishing composition, commercially available fluorocarbon emulsions, naphthalene sulfonated salts, and stainblockers are mixed into a single bifunctional finishing composition, which imparts both repellency (soil and/or water and oil) and stainblocking abilities. In this regard, non-ionic fluorocarbon emulsions are available from 3M, DuPont, Daikin, and ELF-Atochem. Anionic fluorocarbon emulsions are available from 3M, DuPont, Daikin, and ELF-Atochem. Naphthalene sulfonated salts are available from Witco, and Rohm and Haas, and stainblockers are available from 3M, Sandoz, Miles, Nicca, Simco, Ciba Geigy, and ICI. A specific embodiment for a mixture includes the following chemicals:

| CHEMICAL | PERCENT BY WEIGHT | MANUFACTURER |
|---|---|---|
| water | 20 | N/A |
| Foraperle 503 | 14 | ELF ATOCHEM |
| PETRO AA | 9 | WITCO |
| APG-502 | 35 | DAIKIN |
| N-201A | 22 | SIMCO |

Here, FORAPERLE 503 is an NFE, PETRO AA is an NSS, APG-502 is an AFE, and N-201A is an SB. The mixture is a blended composition having either an off-white/milky color or a light tan color. These chemicals can either be premixed, or mixed by a carpet mill into a dilute aqueous mixing tank. The advantage of a single chemical for carpet mills is that such reduces the amount of chemical inventories required and helps eliminate weighing errors that can occur when three chemicals have to be introduced into a mixing tank as opposed to one. If the chemicals are mixed at a carpet manufacturing plant, it is important to mix the naphthalene sulfonated salt either with the stainblocker or the fluorocarbon-based repellant(s) to form an intermediate mixture. The intermediate mixture should then be mixed with the remaining ingredient in the three-part combination. The mixing sequence protects the fluorocarbon emulsion from agglomeration as a result of the coalescing effects of contact with the stainblocker.

It thus is seen that protective finishing compositions and methods of manufacture of such compositions are now provided which enable the finishing application of nylon carpet to be a one step process rather than two. The methods allow for the addition of a stainblocker to a fluorocarbon-based repellant without the normal result of agglomeration of the fluorocarbon emulsion.

While this invention has been described in detail with particular references to the preferred embodiments thereof, it should be understood that many modifications and additions may be made thereto, in addition to those expressly recited, without departure from the spirit and scope of the invention as set forth in the following claims.

We claim:

1. A protective finishing composition for protecting nylon fibers comprising an aqueous mixture of a stainblocker, a fluorocarbon-based repellant emulsion and a naphthalene sulfonated salt fluorocarbon anti-coalescing agent in an amount effective to prevent said fluorocarbon-based repellant from coalescing, and wherein said stainblocker is selected from the group consisting of syntans, sulfonated novolacs and sulfonated aromatic aldehyde condensation products, and wherein said fluorocarbon-based repellant emulsion is selected from the group consisting of anionic and non-anionic fluorocarbon-based repellant emulsions.

2. The protective finishing composition of claim 1 wherein said naphthalene sulfonated salt is alkylated.

3. The composition of claim 2 wherein said alkylated naphthalene sulfonated salt is an alkylated naphthalene sulfonated sodium salt.

4.The protective finishing composition of claim 1 wherein said fluorocarbon-anticoalescing agent has the structural formula;

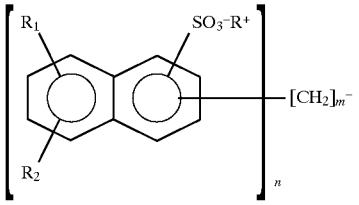

where R is an alkali earth metal selected from the group consisting essentially of Li, Na, K, and Cs, where $R_1$ is hydrogen or an alkyl group having between 1 and 8 carbon atoms, where $R_2$ is hydrogen or an alkyl group having between 1 and 20 carbon atoms, where n is between 1 and 30 and where m is equal to 0 or 1.

5. The protective finishing composition of claim 4 where m is 0 and n is 1.

6. The protective finishing composition of claim 4 wherein R is Na, $R_1$ is a methyl group, and $R_2$ is an alkyl group having between 1 and 8 carbon atoms.

7. A method for producing a protective finishing composition for protecting nylon fibers comprising the steps of mixing a naphthalene sulfonated salt with a fluorocarbon-based repellant selected from the group consisting of anionic and non-anionic fluorocarbon based emulsions, and mixing the resulting mixture with a stainblocker selected from the group consisting of syntans, sulfonated novolacs and sulfonated aromatic aldehyde condensation products, the naphthalene sulfonated salt being mixed in an amount effective to prevent said fluorocarbon-based repellant from coalescing.

8. A nylon fiber carpet protected by applying thereto a protective finishing composition produced according to the method of claim 7.

9. A method for producing a protective finishing composition for protecting nylon fibers comprising the steps of mixing a naphthalene sulfonated salt with a stainblocker selected from the group consisting of syntans, sulfonated novolacs and sulfonated aromatic aldehyde condensation products, and mixing the resulting mixture with a fluorocarbon-based repellant selected from the group consisting of anionic and non-anionic fluorocarbon based repellant emulsions, the naphthalene sulfonated salt being mixed in an amount effective to prevent the fluorocarbon-based repellant from coalescing.

10. A nylon fiber carpet protected by applying thereto a protective finishing composition produced according to the method of claim 9.

* * * * *